US007766330B2

(12) United States Patent
Balzano

(10) Patent No.: US 7,766,330 B2
(45) Date of Patent: Aug. 3, 2010

(54) COMBINED GAMING MACHINE AND RELAXASIZER

(76) Inventor: Alfiero Balzano, 11371 Monarch St., Garden Grove, CA (US) 92841

( * ) Notice: Subject to any disclaimer, the term of this patent is extended or adjusted under 35 U.S.C. 154(b) by 0 days.

(21) Appl. No.: 11/438,495

(22) Filed: May 22, 2006

(65) Prior Publication Data

US 2007/0267809 A1 Nov. 22, 2007

(51) Int. Cl.
*G07F 17/34* (2006.01)
*A63F 7/00* (2006.01)

(52) U.S. Cl. ..... 273/143 R

(58) Field of Classification Search ..... 273/148 R, 273/309, 139; 463/20; D21/370
See application file for complete search history.

(56) References Cited

U.S. PATENT DOCUMENTS 3,043,294 A * 7/1962 Neff ..... 601/61
3,071,132 A * 1/1963 Lucht ..... 601/65
3,304,935 A * 2/1967 Kennedy et al. ..... 601/65
5,121,861 A * 6/1992 Wong ..... 223/114
5,439,437 A * 8/1995 Lyons ..... 601/115
5,501,682 A * 3/1996 Edwards-Cofie ..... 601/61
D419,683 S * 1/2000 Miyake ..... D24/213
D420,450 S * 2/2000 Anthony et al. ..... D24/212
6,124,578 A * 9/2000 Elliot ..... 219/528
6,532,969 B2 * 3/2003 Nuzzo ..... 132/286
2004/0051249 A1 * 3/2004 Seelig et al. ..... 273/309
2004/0149866 A1 * 8/2004 Boucher et al. ..... 248/127
2006/0014586 A1 * 1/2006 Gatto et al. ..... 463/46

FOREIGN PATENT DOCUMENTS

GB 2307403 * 5/1997

* cited by examiner

*Primary Examiner*—William M Pierce
(74) *Attorney, Agent, or Firm*—Stetina Brunda Garred & Brucker

(57) ABSTRACT

A device for relaxing a participant while participating in an activity is provided. The device may comprise an amusement machine and a relaxasizer. The amusement machine may be interactive with the participant. Also, the amusement machine may have a receptacle having a starter circuit for permitting the participant to interact with the amusement machine. The relaxasizer may be positioned adjacent to the amusement machine for massaging the participant's lower body while the participant interacts with the machine. Also, the relaxasizer may be activated by the starter circuit of the amusement machine.

2 Claims, 2 Drawing Sheets

COMBINED GAMING MACHINE AND RELAXASIZER

CROSS-REFERENCE TO RELATED APPLICATIONS

Not Applicable

STATEMENT RE: FEDERALLY SPONSORED RESEARCH/DEVELOPMENT

Not Applicable

FIELD OF THE INVENTION

The present invention relates to the field of massaging devices and more particularly to a novel combined amusement machine having a foot and leg massager integral with the cabinet of the machine, whereby a user can simultaneously use the machine for its intended purpose while having the user's feet and/or legs massaged by a vibrating means.

BRIEF DESCRIPTION OF THE PRIOR ART

In the past, it has been conventional practice to employ vibrating massaging devices which are hand-held or which are incorporated into a chair, whereby the user can readily be massaged by vibrating means in order to provide relaxation, muscle tone, and increase in circulation. However, such past vibrating devices are used individually and not in unison with any other device to which the user can direct his interest. In other instances, amusement machines, such as used in video parlors or the like, are solely used for amusement purposes without combining with any physical therapy devices. One problem of prior art amusement machines is that the participant may become fatigued while playing the amusement machine. As such, the participant may have to walk around to circulate his/her blood during long durations of play. Unfortunately, when the participant is not playing the amusement game (e.g., slot machine, etc.) the casino does not make any money because the player is busy walking around and not playing with the amusement machine.

Therefore, there is a need in the art for an improved amusement machine.

SUMMARY OF THE INVENTION

The above problems and difficulties have been avoided by the present invention which provides a combined amusement machine and massaging means which permits the user to apply his skills in operating the machine for amusement purposes while simultaneously having his feet and/or legs massaged by a vibrating device. In one form of the invention, a cabinet is provided having an upper portion housing. The amusement device may be operated via push-buttons incorporated into a console or by means of a manual manipulation of a handle. The operation of the amusement device, such as a game of skill or the like, is initiated by the user placing a coin, magnetic card, or the like, into a receptacle having a start circuit for initiating operation of the gaming or amusement device. The cabinet includes a lower portion having a flexible vibrating plate or treadle which will accommodate placement of one or both feet of the user as the user plays the gaming or amusement machine. Circuitry is provided for power and speed control coupled to a vibrating motor operably connected to the plate or treadle so that simultaneous vibration of the plate and operation of the gaming or amusement device can occur. The vibrating plate is mounted on resilient spaces to a stationary rigid platform attached to the lower cabinet portion of the overall cabinet. Thereby simultaneous operation of the gaming machine and the vibrating plate occurs to not only amuse the user but encourages blood circulation, muscle tone and relaxation.

In an aspect of the present invention, a novel combined gaming/amusement machine which incorporates an integral vibrating unit on which the user places his or her feet while operating the machine simultaneously for amusement purposes is provided.

In yet another aspect of the present invention, a combined gaming/amusement machine having a display and operating console which is operated by the user while enjoying the comforts and benefits of a vibrating device massaging his or her feet during operation of the machine is provided.

In another aspect of the present invention, a vibrating system in combination with a gaming and amusement device which allows activation of the vibrating system by the user placing his or her feet on a foot plate which causes the system to remain in an "on" condition and remain "on" for a preset amount of time is provided.

In another aspect of the present invention, a gaming cabinet with a pedestal base enclosing a vibrating unit which is installed as an integral part of the overall base and is electronically connected to amusement circuits and the vibrating unit for simultaneous operation is provided.

In another aspect of the present invention, the gaming unit and the vibrating unit are in a single cabinet with the vibrating unit recessed into the base so that no part of the cabinet resides in a walkway in front of the cabinet base.

BRIEF DESCRIPTION OF THE DRAWINGS

These and other features and advantages of the various embodiments disclosed herein will be better understood with respect to the following description and drawings, in which like numbers refer to like parts throughout, and in which.

DESCRIPTION OF PREFERRED EMBODIMENT

Figure 1:
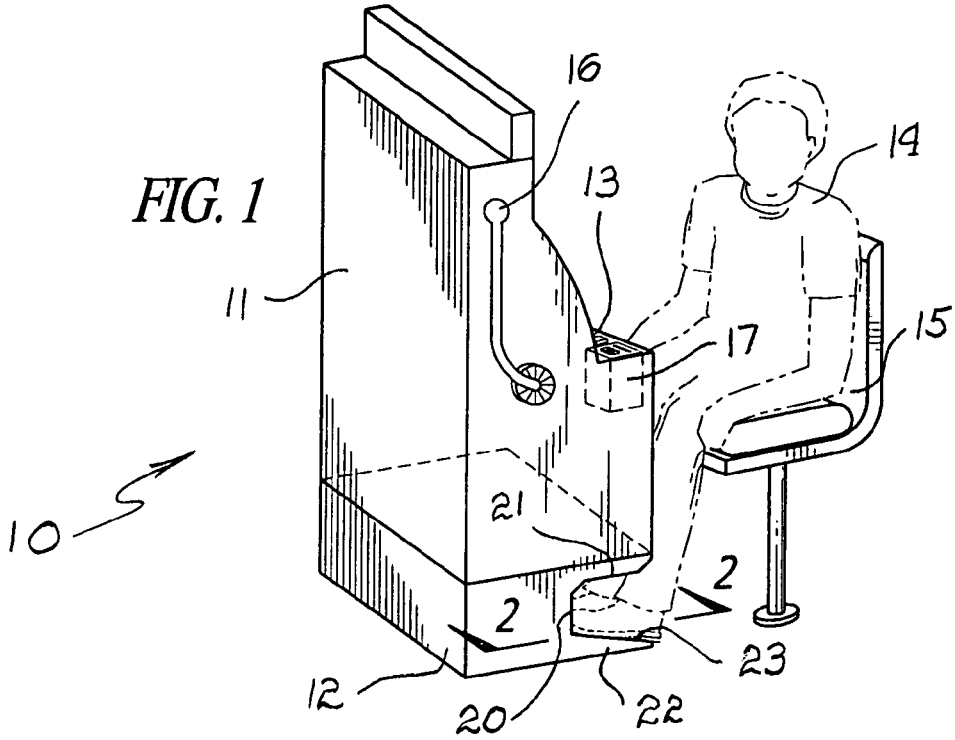
FIG. 1 is a perspective view illustrating the combined gaming machine and relaxasizer illustrated in position for use by a user represented in broken lines.

Referring to FIG. 1, the novel combined gaming and amusement machine incorporating the relaxisizer unit is illustrated in the general direction of arrow 10 which includes an upper cabinet 11 and a lower or pedestal cabinet 12. The upper cabinet 11 includes an amusement apparatus, such as a video game, a game of chance, or the like, and includes a display screen (not shown) as well as an operating console, broadly indicated by numeral 13. A user represented in broken lines and by numeral 14 resides in front of the machine and, in most instances, occupies a conventional chair 15. Once seated, the user may operate the gaming or amusement machine by actuating selected buttons on the console 13 or by physically manipulating an arm 16 movably mounted on the side of the upper cabinet 11. The console includes a start-up mechanism for receiving coins, credit cards of the plastic type, magnetic cards or the like.

The starter circuit 17 is coupled to the gaming or amusement circuits and the display unit so that the user 14 may play a timed game. The user may use the buttons on the console 13 or may use the operating arm or lever 16.

The lower cabinet or pedestal 12 of the cabinet 11 includes a recessed cavity 20 defined by a back wall, an upper surface 21 and a side panel 22. While the user is seated on seat 15, his feet are placed on a plate or treadle 23 which vibrates as initiated by buttons on the console 13 or the handle or lever 16 when coins or other activating means are placed in the starter 17.

Therefore, the user 14 may readily enjoy the comfort of the chair 15 while playing the game shown on the display and as controlled by the buttons on the console and/or the handle or lever 16. Simultaneously, the vibrating plate or treadle 23 massages the feet and/or legs of the user and the user's feet are within the pedestal or base of the cabinet and do not reside in the walkway in front of the cabinet.

Figure 2:
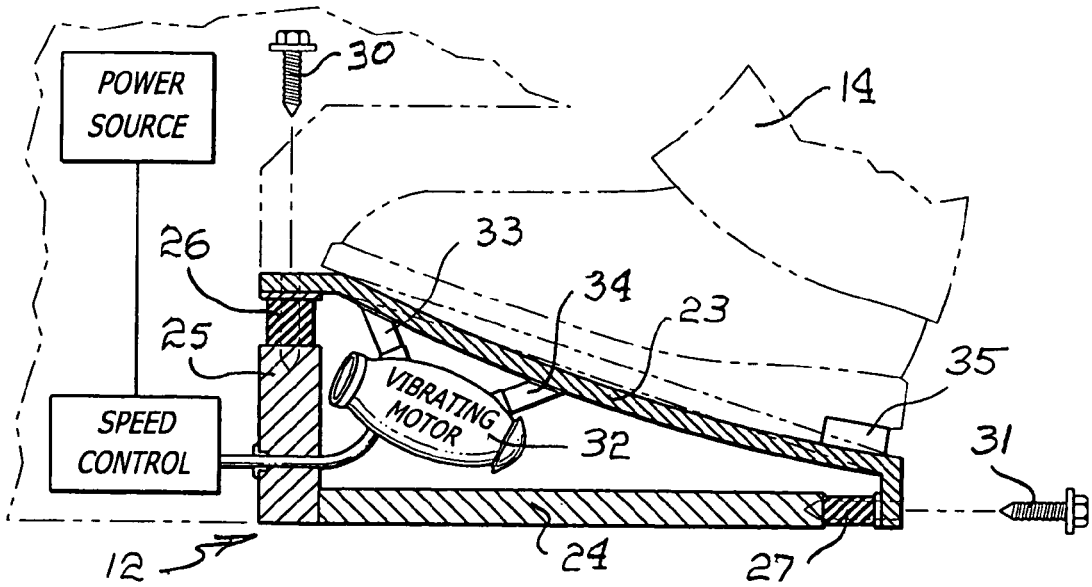
FIG. 2 is an enlarged transverse sectional view of the vibrating unit incorporated into the cabinet shown in FIG. 1 as taken in the direction of arrows 2-2 thereof.

Referring now in detail to FIG. 2, it can be seen that the lower cabinet or base pedestal 12 includes a support 24 with an urpright backing 25. The plate or treadle 23 is mounted to the back support 25 by means of a resilient pad or flexible means 26 while the opposite end of the treadle is attached to the support 24 by a similar resilient pad 27. The respective opposite ends of the plate or treadle 23 are attached to the respective pads 26 and 27 by fasteners, such as screw fasteners 30 and 31 respectively.

In order to vibrate the plate or treadle 23, a vibrating motor 32 is placed in a concealed cavity underneath the plate or treadle by means of support braces 33 and 34. Therefore, once the vibrating motor has been actuated, the eccentric movements of the vibrating motor will be transferred to the plate or treadle 23 via the braces 33 and 34. The system uses a simple motor which is operated "off" center or eccentrically so as to vibrate when energized. The motor may be powered by a conventional 110 v but may be wound to operate efficiently on various voltages. By mounting this vibrating motor to the treadle or plate arranged at an angle to the back wall 25, comfort is provided to the tired feet of the user 14. This same treadle or plate may incorporate a bar stop 35 to prevent the user's feet from dislodging from the plate or treadle. The mounting treadle or plate is attached to the support frame using "rubber stand-off's" allowing the full vibration excitement to be transmitted to the user's feet resting on the treadle or plate. The electrical energy to operate and excite the treadle or plate can be varied by the addition of a "speed continual" permanently wired or removably controlled. It is important to understand that the relaxasizer taking the form of the vibration unit can also be interfaced to operate for a desired period each time the gaming machine is activated, such as by pulling the manual arm or lever 16 or by pressing a play button on the console 13 or by circuit activation by insertion of a coin or credit card.

Figure 3:
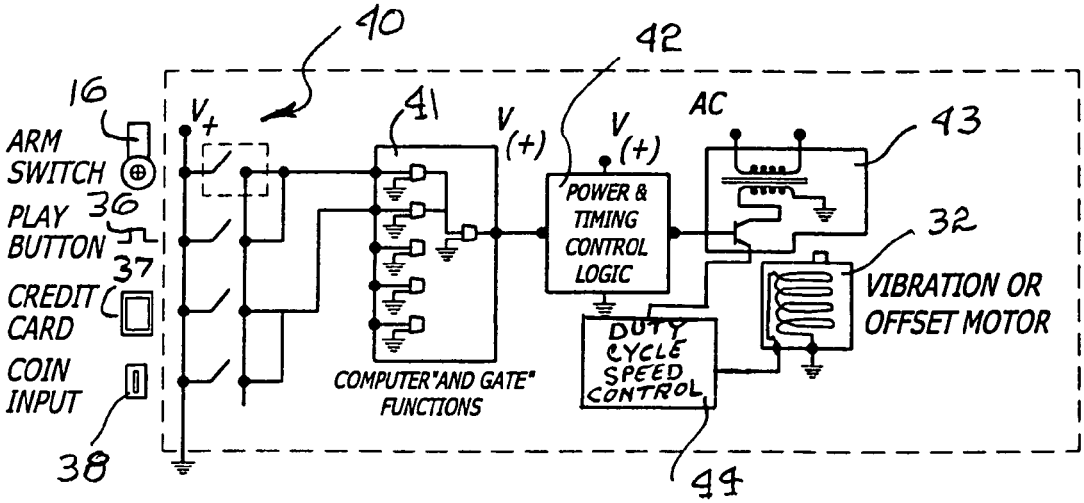
FIG. 3 is an electrical circuit diagram illustrating the electrical control of the vibration or "offset" motor used in the vibration unit.

Referring now in detail to FIG. 3, the typical operational circuit is shown for controlling and operating the motor 32. The circuit may be actuated by movement of the lever arm 16, depression of a play button or swiping of a credit card 37 or alternately by insertion of a coin into the coin input receptacle 38. Numeral 40 represents a relay or switching sensor circuit which is responsive to the actuation medium 16, 36-38 or the like. Once actuated, voltage is applied to a computer "and-gate" as indicated by numeral 41. The functions are then applied to a power and timing control logic network 42, followed by applying signals to a power circuit 43. A duty cycle speed control 44 is connected between the power circuit 43 and the vibration motor 32. It is to be understood that the motor is eccentrically operated so that it will vibrate and that the vibrations are induced into the treadle or plate 23 as shown in FIG. 2.

Figure 4:
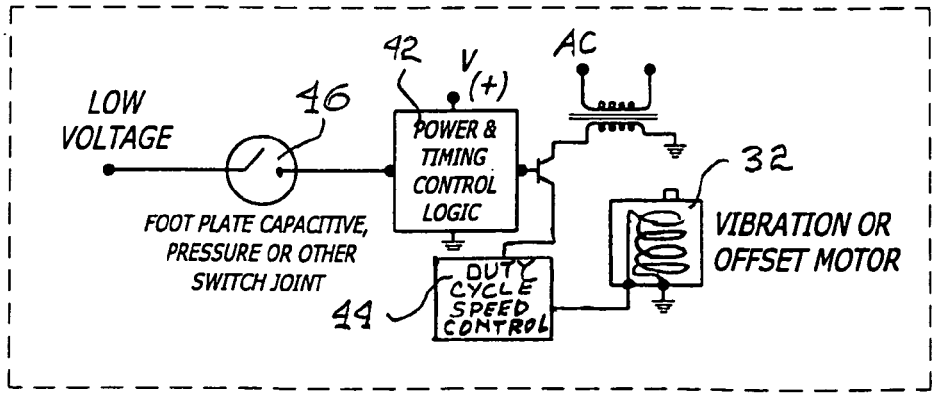
FIG. 4 is a electrical circuit diagram illustrating an alternate electrical system for operating the vibration or "offset" motor.

The circuit shown in FIG. 3 differs from the following circuit shown in FIG. 4 in that the FIG. 3 system remains "on" as long as any of the sensor inputs 16, 36-38 or combination of inputs fulfill the "and-gate" computer requirements. The system employs a simple motor which is designed to be "off" center so as to vibrate as it operates. The motor is powered by 110 v but can be constructed to efficiently operate on various voltages. The electrical energy to operate and excite the system can be varied by the addition of a "speed control" permanently wired or remotely controlled and is indicated by numeral 44.

Referring now in detail to FIG. 4, an alternative system control is illustrated which permits activation of the vibration system by simply placing the user's feet or foot on the foot treadle or plate 23. This causes the system to go "on" and remain "on" for a preset amount of time. The system automatically re-energizes if the person's feet are still in place. This would cause the system to remain "on" and remain "on" for the preset amount of time. The system automatically re-energizes if the person's feet are still on the plate or treadle. If the user's foot pressure is not exerting a force on the plate or treadle, the system will automatically turn "off" at the end of a preset controlled time.

The foot pedal for operation of the plate or treadle 23 is indicated by numeral 46 and the circuit may involve a pivoting foot plate or other pressure or switch arrangement. The foot switch or the like is connected between a low voltage source and the power and timing control logic network 42. The rest of the circuitry is identical to that shown in FIG. 3.

In view of the foregoing, it can be seen that the present invention provides an amusement device combined with a relaxation module useful in massaging the feet or foot of a user. The relaxation module is mounted in the lower pedestal or lower portion of the cabinet and includes a vibrating motor which may be operated from a power source and which may include speed control. If desired, a heating circuit can be placed into the plate or treadle 23 as an option as a flexible heating circuit. It is important to note that the cabinet includes both the pedestal base at the lower end as an integral part of the overall cabinet and that the vibratory system is integral to the cabinet, and, for safety reasons, is recessed into the pedestal base, leaving nothing in the walkway in front of the cabinet. Various shapes and sizes are envisioned as well as a variety of speed adjustments with the final result providing relief to tired feet and permitting the user to concentrate more on the gaming or amusement priorities of the display in the upper portion of the cabinet. The treadle or plate 23 is attached to the lower support frame utilizing resilient stand-offs, such as composed of rubber or rubber-like composition, which allows a full vibration excitement to be transmitted to the feet of the user resting upon the plate or treadle. The vibration system can be interfaced to operate for a desired period of time during which the amusement or gaming portion of the invention is actuated. Such an interface is connected to the movable arm 16 or to any of the inputs generated by inputs 36-38 inclusive.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A foot vibration unit for relaxing a user while operating a slot machine, the slot machine having a rotatable arm for initiating operation thereof, the vibration unit comprising:

a vibrating motor having a foot receiving plate mechanically coupled to the vibration motor;

a vibration unit operational circuit operative to activate the vibration motor in response to movement of the rotatable arm;

the operational circuit and the vibration motor being electrically isolated from the slot machine.

2. The foot vibration unit of claim 1 further comprising a timer to control the duration of the operation of the foot vibrator.

* * * * *